US005600417A

United States Patent [19]

Iguchi et al.

[11] Patent Number: 5,600,417

[45] Date of Patent: Feb. 4, 1997

[54] DEVELOPING DEVICE FOR ELECTROPHOTOGRAPHIC APPARATUS

[75] Inventors: Michihisa Iguchi; Hiroshi Hashizume; Seiji Arai; Yoshiaki Okano; Chinobu Sakai; Hirotaka Fukuyama; Takahito Kabai; Kouichirou Satou; Tetsuya Nakamura; Satoshi Katagata, all of Tokyo, Japan

[73] Assignees: Kabushiki Kaisha Toshiba, Kawasaki; Kabushiki Kaisha TEC, Shizuoka, both of Japan

[21] Appl. No.: 113,696

[22] Filed: Aug. 31, 1993

[30] Foreign Application Priority Data

Aug. 31, 1992 [JP] Japan ..... 4-232409

[51] Int. Cl.[6] ..... G03G 15/08

[52] U.S. Cl. ..... 399/279

[58] Field of Search ..... 355/245, 259; 118/653, 656; 430/120

[56] References Cited

U.S. PATENT DOCUMENTS

| | | | |
|---|---|---|---|
| 3,731,146 | 5/1973 | Bettiga et al. . | |
| 4,119,060 | 10/1978 | Mochizuki et al. | 118/653 |
| 4,368,970 | 1/1983 | Hays | 355/259 |
| 4,647,180 | 3/1987 | Watanabe | 355/246 |
| 4,967,231 | 10/1990 | Hosoya et al. | 355/259 X |
| 5,062,385 | 11/1991 | Nishio et al. | 118/653 |
| 5,170,213 | 12/1992 | Yamaguchi et al. | 355/259 X |
| 5,191,170 | 3/1993 | Yoshida et al. | 355/245 |
| 5,210,575 | 5/1993 | Kikuchi | 355/259 |
| 5,220,129 | 6/1993 | Nishio et al. | 118/656 |
| 5,278,616 | 1/1994 | Hirano et al. | 355/259 |
| 5,287,150 | 2/1994 | Kinoshita et al. | 355/259 |

FOREIGN PATENT DOCUMENTS

| | | | |
|---|---|---|---|
| 62-242975 | 10/1987 | Japan | 355/259 |

*Primary Examiner*—Joan H. Pendegrass

*Attorney, Agent, or Firm*—Finnegan, Henderson, Farabow, Garrett & Dunner, L.L.P.

[57] ABSTRACT

In a developing device for developing an electrostatic latent image formed on a photosensitive member in an electrophotographic apparatus, a developing roller and a developing blade are formed such that the hardness of the surface of the developing blade is higher than the hardness of the surface of the developing roller by 30 degrees or more in JIS-A hardness. The developing blade deforms and bites into the developing roller. Accordingly, the developing roller can be brought into tight contact with the developing blade, and a great frictional force is applied to the toner passing between the developing roller and blade to fully charge the toner.

16 Claims, 6 Drawing Sheets

| SURFACE ROUGHNESS | FOGGING | DENSITY | UNIFORMITY |
|---|---|---|---|
| 1.0 | ◎ | × | × |
| 1.5 | ◎ | △ | × |
| 2.0 | ◎ | ○ | △ |
| 3.5 | ◎ | ◎ | ◎ |
| 6.0 | ○ | ◎ | ◎ |
| 10.0 | × | ◎ | ◎ |
◎ EXCELLENT
○ GOOD
△ FAIR
× BAD
FIG. 6
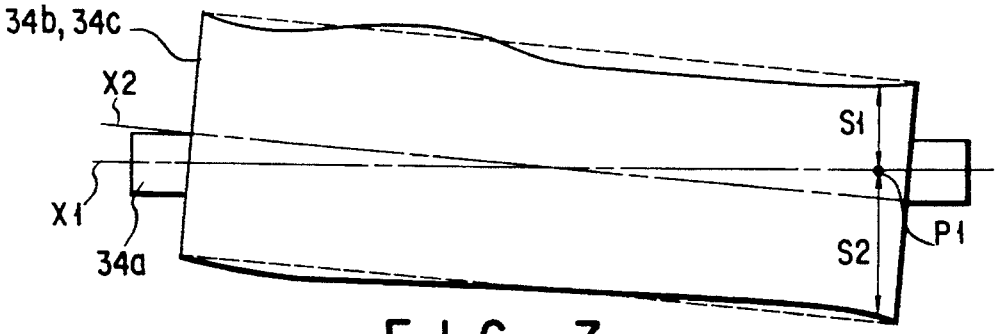
FIG. 7
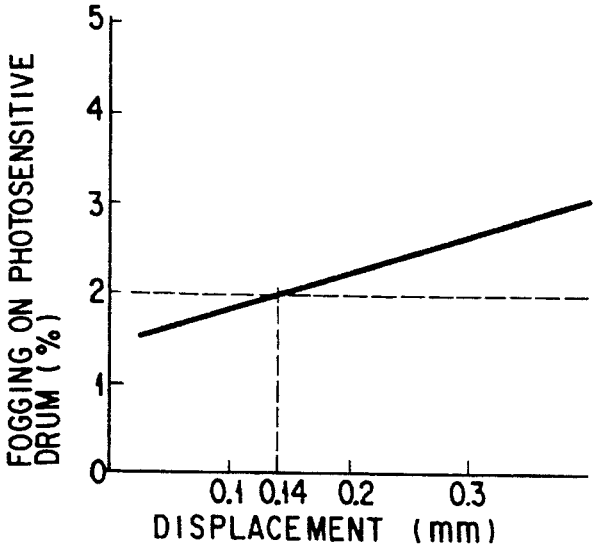
FIG. 8

DEVELOPING DEVICE FOR ELECTROPHOTOGRAPHIC APPARATUS

BACKGROUND OF THE INVENTION

1. Field of the Invention

The present invention relates to a developing device and toner for use in an electrophotographic apparatus for printing images in accordance with an electrophotographic process.

2. Description of the Related Art

In an electrophotographic apparatus, a photosensitive surface of a photosensitive drum is charged by a charging device at a predetermined potential (e.g. −600 v), and then the photosensitive surface of the photosensitive drum is exposed by an exposure unit in accordance with an image to be printed, thus forming an electrostatic latent image is formed on the photosensitive surface of the photosensitive drum. The electrostatic latent image is developed by a developing device in such a manner that toner is attached to the photosensitive surface of the photosensitive drum in accordance with the electrostatic latent image.

In the developing device, toner is carried and conveyed on a developing roller and put in contact with the surface of the photosensitive drum. When the toner on the developing roller is conveyed, it is formed into a film layer by a developing blade which is made of metal and situated in contact with the developing roller. At the same time, the toner is charged by friction to have the same polarity as that of the potential charged on the photosensitive drum (i.e., negative polarity). A developing bias of a low voltage (e.g. −200 v) and of the same polarity as that of the potential of the photosensitive drum is applied to the developing roller. Toner is selectively attached to the photosensitive drum by the function of the electric field produced in accordance with the electrostatic latent image, the developing bias, and the charge of toner. Specifically, toner is not attached to a non-exposed portion on the photosensitive drum, since the potential of the non-exposed portion is higher than that of the toner. On the other hand, toner is attached to an exposed, discharged portion on the photosensitive drum, since the potential of the exposed portion is lower than that of the toner. Thus, a toner image corresponding to the electrostatic latent image is formed on the surface of the photosensitive drum. The toner image is transferred on a printing paper sheet by a transfer device.

Since image development is performed by the function of the electric field, the development process is not normally carried out if the amount of charges of toner does not reach a predetermined level. A so-called "fogging" phenomenon occurs and toner adheres to the non-exposed region. The quality of printed images is degraded by a fogging. Further, toner is wasted by a fogging.

A rubber roller is employed as the developing roller. In general, as the hardness of the rubber roller increases, the manufacturing precision increases. Therefore, a hardness of a conventional developing roller is high.

However, if the hardness of the developing roller is high, the contact between the developing roller and the metal developing blade tends to unstable. Consequently, some toner particles may pass between the developing roller and developing blade so that they receive little friction and have a small amount of charges may present. A fogging occurs due to these toner particles.

SUMMARY OF THE INVENTION

An object of the present invention is to provide a developing device capable of uniformly charging toner, thereby decreasing the possibility of fogging and realizing the printing of a high-quality image with little waste toner.

Another object of the present invention is to provide toner suitable for stable charging in a developing device, thereby decreasing the possibility of fogging and realizing the printing of a high-quality image with little waste toner.

According to the present invention, there is provided a developing device for developing an electrostatic latent image formed on a photosensitive member in an electrophotographic apparatus, the developing device comprising:

means for containing toner;

a developing roller for carrying on its surface the toner contained in said containing means and bringing the toner into contact with the photosensitive member; and a developing blade, adapted to be in contact with the developing roller, for charging by friction the toner carried on the developing roller, wherein the hardness of the developing blade is higher than the hardness of the developing roller.

According to the present invention, there is provided another developing device for developing an electrostatic latent image formed on a photosensitive member in an electrophotographic apparatus, the developing device comprising:

means for containing toner;

a developing roller for carrying on its surface the toner contained in said containing means and bringing the toner into contact with the photosensitive member; and a developing blade, adapted to be in contact with the developing roller, for charging by friction the toner carried on the developing roller, wherein a surface roughness of the developing blade is less than a predetermined roughness determined on the basis of a particle size distribution of the toner.

According to the present invention, there is provided a further developing device for developing an electrostatic latent image formed on a photosensitive member in an electrophotographic apparatus, the developing device comprising:

means for containing toner;

a developing roller for carrying on its surface the toner contained in said containing means and bringing the toner into contact with the photosensitive member; and a developing blade, adapted to be in contact with the developing roller, for charging by friction the toner carried on the developing roller, wherein a surface roughness of the developing roller is less than a predetermined roughness determined on the basis of a particle size distribution of the toner.

According to the present invention, there is provided a still another developing device for developing an electrostatic latent image formed on a photosensitive member in an electrophotographic apparatus, the developing device comprising:

means for containing toner;

a developing roller for carrying on its surface the toner contained in said containing means and bringing the toner into contact with the photosensitive member; and a developing blade, adapted to be in contact with the developing roller, for charging by friction the toner carried on the developing roller, wherein a difference between a maximum distance and a minimum distance between an axis of the developing roller and a surface of the developing roller is less than 0.14 mm.

According to the present invention, there is provided a still further developing device for developing an electrostatic latent image formed on a photosensitive member in an electrophotographic apparatus, the developing device comprising:

means for containing toner;

a developing roller for carrying on its surface the toner contained in said containing means and bringing the toner into contact with the photosensitive member; and a developing blade, adapted to be in contact with the developing roller, for charging by friction the toner carried on the developing roller, wherein a displacement of a contacting portion of the developing blade is within a circle with a diameter of 0.14 mm.

According to the present invention, there is provided a still another developing device for developing an electrostatic latent image formed on a photosensitive member in an electrophotographic apparatus, the developing device comprising:

means for containing toner;

a developing roller for carrying on its surface the toner contained in said containing means and bringing the toner into contact with the photosensitive member; and a developing blade, adapted to be in contact with the developing roller, for charging by friction the toner carried on the developing roller, wherein a surface of the developing blade comprises a material tending to be worn due to contact with the toner.

According to the present invention, there is provided a still further developing device for developing an electrostatic latent image formed on a photosensitive member in an electrophotographic apparatus, the developing device comprising:

a toner container for containing toner;

a developing roller for carrying on its surface the toner contained in said toner container and bringing the toner into contact with the photosensitive member; and a developing blade, adapted to be in contact with the developing roller, for charging by friction the toner carried on the developing roller, wherein a maximum height of an internal toner containing space of the toner container from an axis of the developing roller is 60 mm or less.

According to the present invention, there is provided toner for use in an electrophotographic apparatus, wherein a ratio of a standard deviation to an average particle size is 35% or less.

According to the present invention, there is provided toner for use in an electrophotographic apparatus, wherein a percentage of toner particles having a particle size of ½ or less of an average particle size is 5% or less.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIG. 6 shows an evaluation result of printed images obtained by using developing rollers with different surface roughnesses;

FIG. 7 schematically shows a displacement of the surface of the developing roller;

FIG. 8 shows the relationship between the amount of displacement of the surface of the developing roller and the fogging on the photosensitive drum;

DETAILED DESCRIPTION OF THE PREFERRED EMBODIMENTS

A preferred embodiment of a developing device for an electrophotographic apparatus and toner used for the electrophotographic apparatus according to the present invention will now be described with reference to the accompanying drawings.

Figure 1:
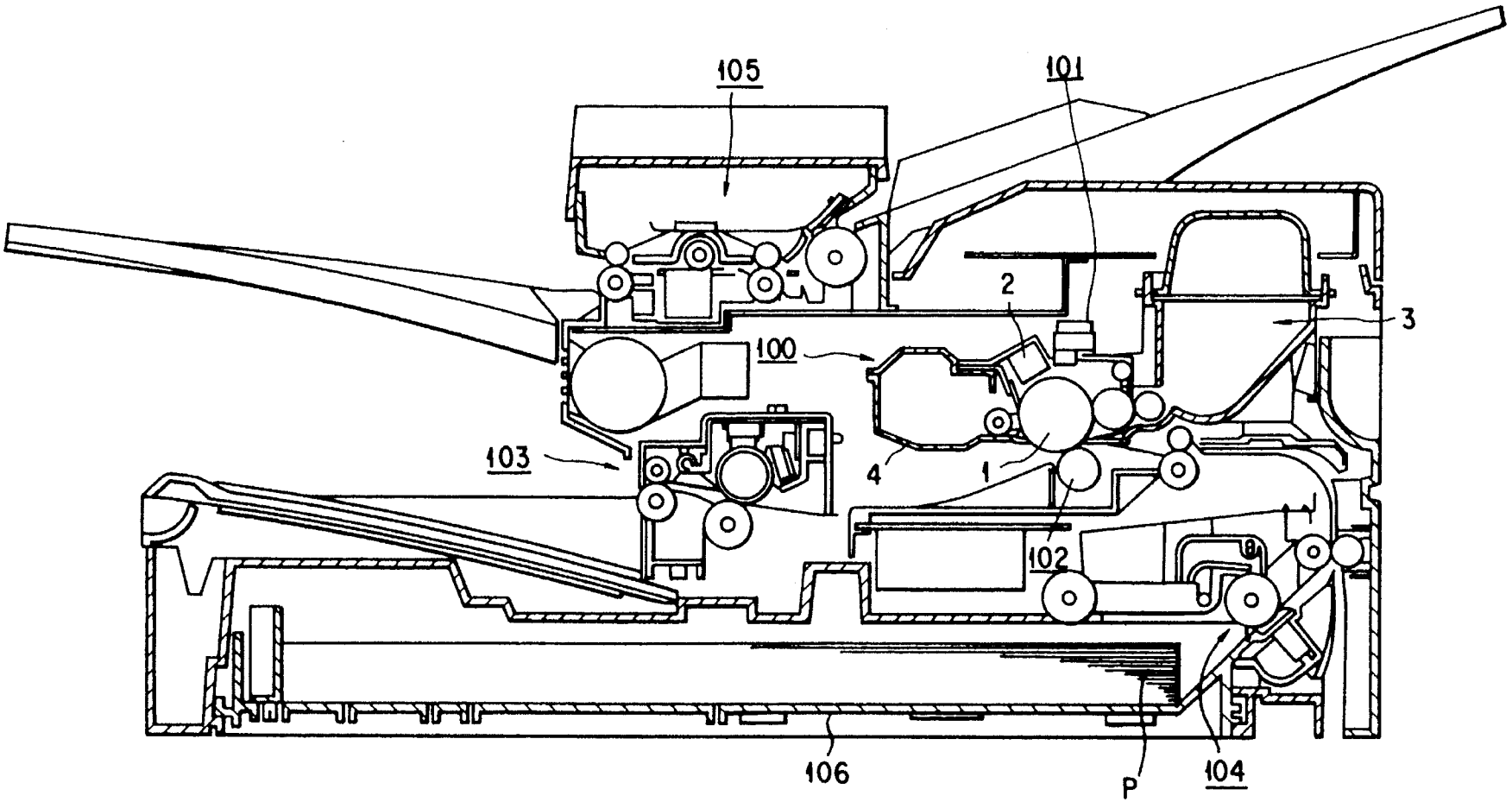
FIG. 1 is a partially sectional view showing the entire structure of a facsimile apparatus to which an electrophotographic apparatus using a developing device according to the present invention is applied.

FIG. 1 is a partially sectional view showing the entire structure of a facsimile apparatus to which an electrophotographic apparatus using a transfer device of the present invention is given.

This facsimile apparatus has a process unit 100, an exposure device 101, a transfer device 102, a fixing unit 103, a paper feed mechanism section 104, and a transmission mechanism section 105.

The process unit 100 is formed as an integral structure of a photosensitive drum 1, a charging device 2, a developing device 3, and a cleaning device 4, and forms a toner image on the surface of the photosensitive drum 1 together with the exposure device 101 in accordance with the so-called Carlson process. The process unit 100 is detachably provided to the main body of the facsimile apparatus.

The exposure device 101 includes an LED head and forms an electrostatic latent image on the photosensitive surface of the photosensitive drum 1 by exposing the photosensitive drum 1.

The transfer device 102 transfers the toner image formed on the photosensitive drum 1 onto a printing sheet P fed by the paper feed mechanism section 104. A large number of printing sheets P are stored in a printing sheet tray 106.

The fixing unit 103 fixes the toner image transferred to a printing sheet P.

The transmission mechanism section 105 optically reads an original to be transmitted and performs photoelectric conversion to generate an image signal. The transmission mechanism section 105 is connected to a communication line (not shown).

Figure 2:
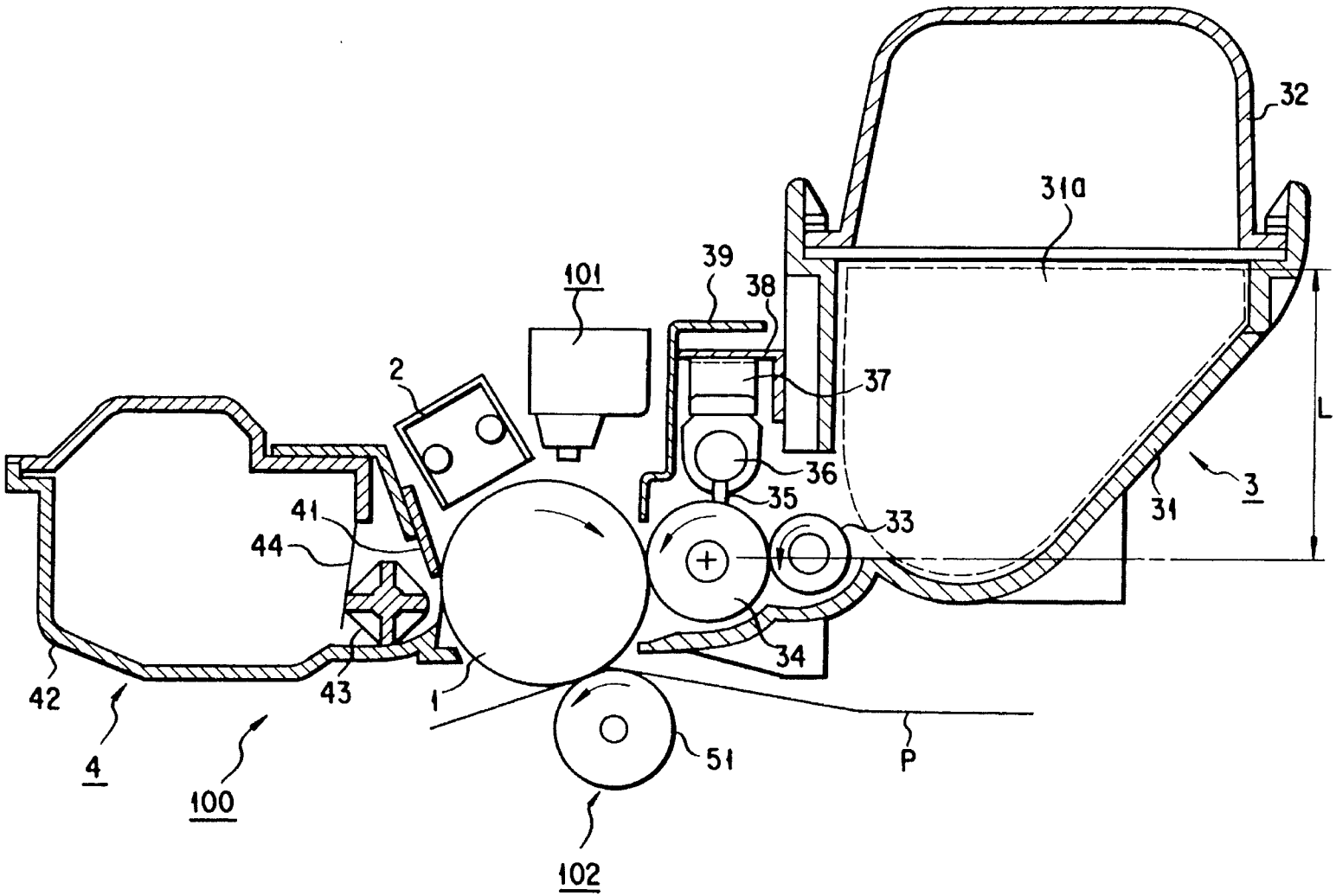
FIG. 2 is a partially sectional view showing the detailed structure of a process unit and a transfer device shown in FIG. 1.

FIG. 2 is a partially sectional view showing the structure of the process unit 100 and the transfer device 102 in detail. Note that the same reference numerals are used to denote the same portions as in FIG. 1.

The photosensitive drum 1 is made of a cylindrical conductor, e.g., aluminum. The outer surface of the cylindrical conductor is coated with a photosensitive conductive material to form a photosensitive layer. The photosensitive drum 1 is rotated in the clockwise direction by a rotary drive mechanism (not shown). The charging device 2, the exposure device 101, the developing device 3, the transfer device 102, and the cleaning device 4 are arranged around the photosensitive drum 1 along the outer surface of the photosensitive drum 1. Of these components, the photosensitive drum 1, the charging device 2, the developing device 3, and the cleaning device 4 are integrally supported by side covers (not shown) to form the process unit 100.

The charging device 2 comprises, e.g., a known scorotron charger and uniformly charges the surface of the photosensitive drum 1 to a predetermined potential (e.g., −600 v).

The developing device 3 comprises a toner hopper 31, a toner pack 32, a feed-roller 33, a developing roller 34, a developing blade 35, a support rod 36, a leaf spring 37, a support 38, and a reinforcing plate 39.

The toner hopper 31 is a hollow container whose side and upper surfaces are partially open, and stores toner (not shown) therein. The toner pack 32 is mounted on the upper open portion of the toner hopper 31. The toner pack 32 is a container having an open surface. The toner pack 32 is filled with the toner, and its opening is sealed with a seal sheet (not shown). When the seal sheet is removed while the toner pack 32 is mounted on the toner hopper 31 with its opening facing the toner hopper 31, as shown in FIG. 2, the toner filled in the toner pack 32 is given to the toner hopper 31.

The feed roller 33 is made of a conductive sponge and arranged at the opening on the side surface of the toner hopper 31 such that it is partly located in the toner hopper 31. The feed roller 33 contacts the developing roller 34. The developing roller 34 is arranged between the photosensitive drum 1 and the feed roller 33. The developing roller 34 contacts both the photosensitive drum 1 and the feed roller 33. The feed roller 33 and the developing roller 34 are rotated in the counterclockwise direction by a rotary drive mechanism (not shown). The feed roller 33 carries the toner stored in the toner hopper 31 and supplies it to the developing roller 34. The developing roller 34 carries the toner given by the feed roller 33 and causes it to contact the surface of the photosensitive drum 1.

Figure 3:
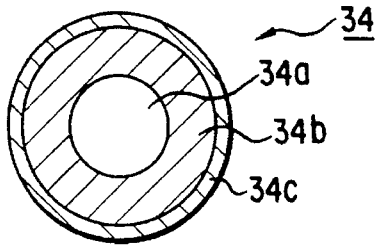
FIG. 3 is a sectional view showing the detailed structure of a developing roller shown in FIG. 2.

FIG. 3 is a cross-sectional view showing the detailed structure of the developing roller 34. This roller 34 has a cylindrical metallic shaft **34*a*. The outer periphery of the shaft 34*a* is surrounded by an elastic layer 34*b* of a resin such as urethane, silicone, EPDM, or NBR. The elastic layer 34, in turn, is surrounded by an electrically conductive resin layer 34*c* of an urethane elastomer. Carbon particles are dispersed in the resin of the elastic layer 34*b*, so that the layer 34 may have electrical conductivity of about $10^5$ to $10^6$ $\Omega\cdot cm^2$. An acrylic resin which tends to be charged with a positive potential is mixed in the electrically conductive resin layer 34*c*** as a charge control agent (CCA).

The developing blade 35 is made of a silicone resin, urethane, or the like. The developing blade 35 is supported by the cylindrical support rod 36 arranged parallel to and above the developing roller 34 and contacts the developing roller 34. The support rod 36 is urged toward the developing roller 34 by the leaf spring 37, fixed to the support 38, with a predetermined force F (about 50 $g/cm^2$ to 100 $g/cm^2$). Thus, the developing blade 35 is urged against the developing roller 34 with the force F. The support 38 is fixed to the side wall of the toner hopper 31 which faces the photosensitive drum 1.

The reinforcing plate 39 is fixed to the support 38 and the side covers (not shown) of the process unit 100 to increase the rigidity of the process unit 100 and to prevent the toner carried by the developing roller 34 from scattering into the inside of the apparatus.

The cleaning device 4 comprises a cleaning blade 41, a used-toner storing portion 42, a used-toner collecting roller 43, and a one-way valve 44.

The cleaning blade 41 is arranged to contact the photosensitive drum 1 in order to scrape off the residual toner attaching to the photosensitive drum 1. The used-toner storing portion 42 recovers the residual toner which is not transferred to the printing sheet and is scraped from the photosensitive drum 1 by the cleaning blade 41. The used-toner collecting roller 43 conveys the toner scraped by the cleaning blade 41 to the used-toner storing portion 42. The one-way valve 44 prevents the toner in the used-toner storing portion 42 from flowing back to the photosensitive drum 1.

In the facsimile apparatus having the structure as described above, an image is printed in the following manner.

First, the surface (photosensitive surface) of the photosensitive drum 1 is charged by the charging device 2 to a predetermined potential (e.g., −600 V). Subsequently, the charged photosensitive surface of the photosensitive drum 1 is exposed by the exposure device 101 in accordance with an image to be printed, thereby forming an electrostatic latent image. Then, the electrostatic latent image formed on the photosensitive surface of the photosensitive drum 1 is developed by the developing device 3.

In the developing device 3, the toner given from the toner hopper 31 mainly by the feed roller 33 is carried by the developing roller 34 and conveyed to be brought into contact with the surface of the photosensitive drum 1. When the toner carried by the developing roller 34 is conveyed, it is formed into a thin layer by the developing blade 35. When the toner is scraped by the developing blade 35, the toner is charged by friction to have the same polarity (negative) as that of the potential charged on the photosensitive drum 1.

Figure 4:
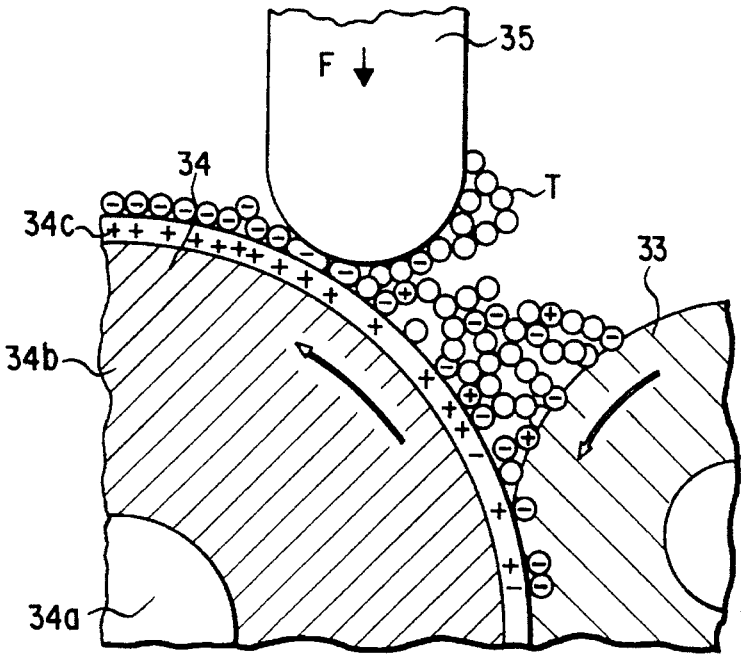
FIG. 4 schematically shows the state in which toner is charged by friction.

FIG. 4 schematically shows the state in which toner is charged by friction. As is shown in FIG. 4, when the developing roller 34 rotates, toner T carried on the developing roller 34 passes between the developing roller 34 and developing blade 35. At this time, the toner T is charged by friction between itself and the developing roller 34 or developing blade 35. Since the acrylic resin which tends to be charged in the positive polarity is mixed in the surface-side electrically conductive resin layer 34*c* of the developing roller 34, the resin layer 34*c* is charged in the positive polarity by friction with the toner T. Accordingly, the toner T is charged in the negative polarity due to the polarization effect caused by the resin layer 34*c*.

A low-voltage developing bias (e.g., −200 V) having the same polarity as that of the potential charged on the photosensitive drum 1 is applied to the developing roller 34 from a developing bias power supply (not shown). The toner selectively attaches to the photosensitive drum 1 by the function of the electric field produced in accordance with the electrostatic latent image, the developing bias, and the charge of toner. More specifically, the toner does not attach to the non-exposed portion of the photosensitive drum 1 since the potential at this portion of the photosensitive drum 1 is more negative than that of the toner, and the toner attaches to the exposed and discharged portion of the photosensitive drum 1 since the potential at this portion of the photosensitive drum 1 is less negative than that of the toner. In this manner, a toner image corresponding to the electrostatic latent image is formed on the surface of the photosensitive drum 1. This toner image is transferred to the printing sheet P by the transfer device 102.

In the transfer device 102, when the image is to be transferred, the switch 54 selects the transfer power supply 52 and a positive transfer voltage (e.g., +1,350 V) is given to the transfer roller 51. The printing sheet P which has been conveyed by the paper feed mechanism section 104 is inserted between the photosensitive drum 1 and the transfer roller 51, and charges are given to the rear surface of the printing sheet P from the transfer roller 51. Since the charges given to the rear surface of the printing sheet P are positive, the negatively charged toner is attracted by the printing sheet P. Then, the toner image formed on the surface of the photosensitive drum 1 is transferred to the printing sheet P.

After the printing sheet P is separated from the photosensitive surface of the photosensitive drum 1, the toner which is not transferred and remains on the surface of the photosensitive drum 1 is removed by the cleaning device 4.

The structure and operation of the apparatus of the invention have been described above briefly. Subsequently, the embodiment for reducing the fogging will now be described in detail.

FIRST EMBODIMENT

According to a first embodiment for reducing a fogging, the developing roller 34 and developing blade 35 are formed such that the surface hardness of the developing roller 34 is lower than that of the developing blade 35 and a difference in surface hardness between the developing roller 34 and developing blade 35 is 20 degrees or more in JIS-A hardness. In the first embodiment, the surface hardness of the developing roller 34 is 30±5 degrees (JIS-A hardness) and the surface hardness of the developing blade 35 is 79±4 degrees (JIS-A hardness).

The surface hardness of each of the developing roller 34 and developing blade 35 is set, as mentioned above. Thus, by bringing the blade 35 into contact with the developing roller 34, the surface of the developing roller 34 is sufficiently depressed and deformed. Since the surface of the developing roller 34 is depressed and deformed by the blade 35, the surface of the developing roller 34 can be put in stable contact with the surface of the developing blade 35. Thereby, stable friction can be caused between the toner, on one hand, and the developing roller 34 and developing blade 35, on the other hand, and the toner can be sufficiently and uniformly charged.

SECOND EMBODIMENT

According to a second embodiment, the surface of the developing blade 35 is formed to have roughness R which meets the condition:

$$R \leq \mu - 2.32635\sigma$$

where R is the surface roughness (ten-point average roughness with a scanning length of 2.5 mm), and $\mu$ and $\sigma$ are an average particle diameter and a standard deviation of the toner which is obtained on the basis of a distribution of particle diameter with regard to volume.

The ten-point average roughness is the average of measurement results of a total of ten points, including five points counted from the largest and five points counted from the smallest, when the distance from a certain reference position to the surface is measured over a predetermined scanning length (2.5 mm in this case).

The toner is made in accordance with the following manner. Toner particles are formed of a binding resin (main resin) obtained by pulverizing a polyester-based resin, a carbon black (coloring agent), a charge control agent (CCA), and a wax (PP or PE). Silica is externally added to the toner particles for the purpose of maintaining flowability and protecting the particles, thereby obtaining the toner. The diameter of the toner particle is 7 to 15 μm.

Figure 5:
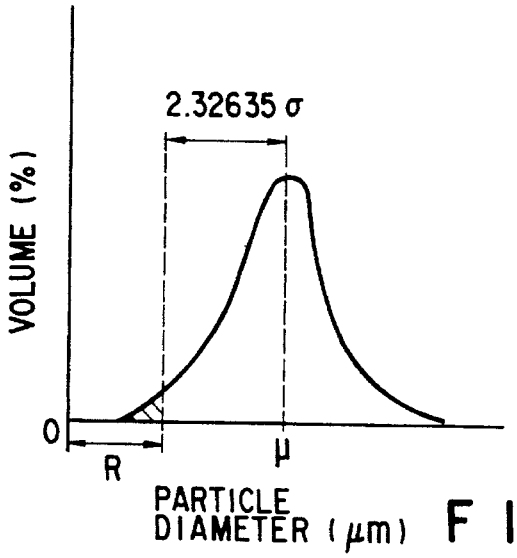
FIG. 5 shows a particle size distribution of toner.

The particle diameters of the toner particles are not uniform but have a distribution as shown in FIG. 5. FIG. 5 shows a frequency distribution of particle diameter with regard to volume. In this volume reference particle size distribution, the range of $2.32635\sigma$ is as shown in FIG. 5. The range of the surface roughness R of the developing blade 35 is as shown in FIG. 5. To measure the average particle diameter and particle size distribution of the toner, a Colter Multisizer Model II (manufactured by Colter Co.) is used.

Therefore, the toner particles having a diameter smaller than the unevenness of the surface of the transfer roller 51 are indicated by a hatched portion in FIG. 5 which is present only in a very low probability in this volume reference particle size distribution. More specifically, [2.32635] is a coefficient with which the probability of presence of a toner having a diameter smaller than $\mu-2.32635\sigma$ is about 1% in this volume reference particle size distribution. When [$R=\mu-2.32635\sigma$], the probability of presence of a toner particle having a diameter smaller than the unevenness of the surface of the developing blade 35 is about 1% in this volume reference particle size distribution.

According to the second embodiment, since the surface of the developing blade 35 is smoothed, as mentioned above, most of the toner particles (99% or more on the basis of volume reference) have a greater size than the surface roughness of the developing blade 35, and toner particles do not enter the surface roughness of the blade 35. If toner particles enter the surface roughness of the developing blade 35, they pass between the developing roller 34 and developing blade 35 with little friction. According to the second embodiment, however, such a situation can be avoided and the toner can be fully charged.

THIRD EMBODIMENT

According to a third embodiment, the surface of the developing roller 34 is formed to have roughness R which meets the condition:

$$R \leqq \mu - 2.32635\sigma$$

where R is the surface roughness (ten-point average roughness with a scanning length of 2.5 mm), and $\mu$ and $\sigma$ are an average particle diameter and a standard deviation of the toner which is obtained on the basis of a distribution of particle diameter with regard to volume.

In the second embodiment, the surface roughness of the developing blade 35 is defined. In the third embodiment, the surface roughness of the developing roller 34 is defined under the same conditions.

According to the third embodiment, toner particles having a size less than the surface roughness of the developing roller 34 are indicated at a hatched region in FIG. 5, and the percentage of such toner particles on the basis of volume reference is very low. Specifically, in the case of [$R=\mu-2.32635\sigma$], the percentage of toner particles having a size less than the surface roughness of the developing roller 35 is about 1% on the basis of volume reference.

According to the third embodiment, since the surface of the developing roller 34 is smoothed, as mentioned above, most of the toner particles (99% or more on the basis of volume reference) have a greater size than the surface roughness of the developing roller 34, and toner particles do not enter the surface roughness of the roller 34. If toner particles enter the surface roughness of the developing roller 34, they pass between the developing roller 34 and developing blade 35 with little friction. According to the third embodiment, however, such a situation can be avoided and the toner can be fully charged.

However, in the case of the developing roller 34, if the surface thereof is too smooth, the ability to carry the toner may decrease. If the ability to carry the toner decreases, a maximum image density may decrease or an amount of toner to be supplied to the photosensitive drum may gradually decrease in the continuous printing.

FIG. 6 shows an evaluation results of printed images obtained by using developing rollers 34 with different surface roughnesses (1.0 μm; 1.5 μm; 2.0 μm; 3.5 μm; 6.0 μm; 10.0 μm) and also using toner with an average particle size of 13.43 μm in the volume reference distribution. As can be seen from FIG. 6, as the surface roughness decreases, the degree of fogging becomes lower but the image density and the uniformity are degraded. The uniformity is defined by a ratio of the density between the leading edge and the trailing edge of the solid image with a 100% black level and reflects the decrease of an amount of toner to be supplied to the photosensitive drum in the continuous printing. It is understood, from the evaluation results, that the surface roughness of the developing roller 34 should desirably be 0.15 time (=2 μm/13.43 μm) or more the volume average particle size of toner.

FOURTH EMBODIMENT

Ideally, the surface of the developing roller 34 should be straight, in parallel to the axis of the roller 34. In addition, the axis X1 of the shaft 34*a* of roller 34 should ideally coincide with the axis X2 of the cylinder constituted by the elastic layer 34*b* and electrically conductive resin layer 34*c*. However, the surface of the developing roller 34 is waved or curved and these axes X1 and X2 are displaced from each other, as shown in FIG. 7. FIG. 7 shows the curve of the surface of developing roller 34 and the displacement of axes X1 and X2 exaggeratedly, for the purpose of clearer understanding.

If there is such a curve of the surface or displacement of axes, a displacement of the surface of developing roller 34 with respect to the surface of the developing blade 35 occurs when the roller 34 is rotated. The amount of displacement varies along the axis of the shaft 34*a*. The amount of displacement at a given point can be expressed by the difference between a maximum distance and a minimum distance (vertical to the axis of the shaft 34*a*) between the axis of the shaft 34*a* and the surface of the developing roller 34. The displacement is affected by the deviation amount of axes X1 and X2 and the cylindricity of the roller surface. The amount of displacement at point P1 in FIG. 7 is expressed by the difference between S1 and S2, where S1 is a minimum vertical distance and S2 is a maximum vertical distance between the axis X1 of the shaft 34*a* and the surface of the developing roller 34.

Owing to the displacement, a gap occurs between the developing roller 34 and developing blade 35, and toner particles pass therebetween with little friction. As a result, the amount of charge of toner decreases.

According to a fourth embodiment, the amount of displacement of the surface of the developing roller 34 is limited to 0.14 mm or less at any point along the axis X1 of the shaft 34*a*.

Thus, passing of toner particles with low friction can be prevented, and the toner is sufficiently charged. FIG. 8 shows the relationship between the displacement of the surface of developing roller 34 and the fogging on the photosensitive drum 1. As shown in FIG. 8, if the amount of displacement of the surface of roller 34 is 0.14 mm or less, the degree of fogging is 2% or less. The fogging of 2% causes no problem in visual aspects, and image quality is not degraded.

The degree of fogging on the photosensitive drum 1 is expressed by a difference in reflectance sampled from a mending tape (manufactured by SUMITOMO 3M) which is adhered to the photosensitive drum 1 corresponding to non-image background area and from a non-used mending tape which is adhered to a white paper sheet.

FIFTH EMBODIMENT

Figure 9A:
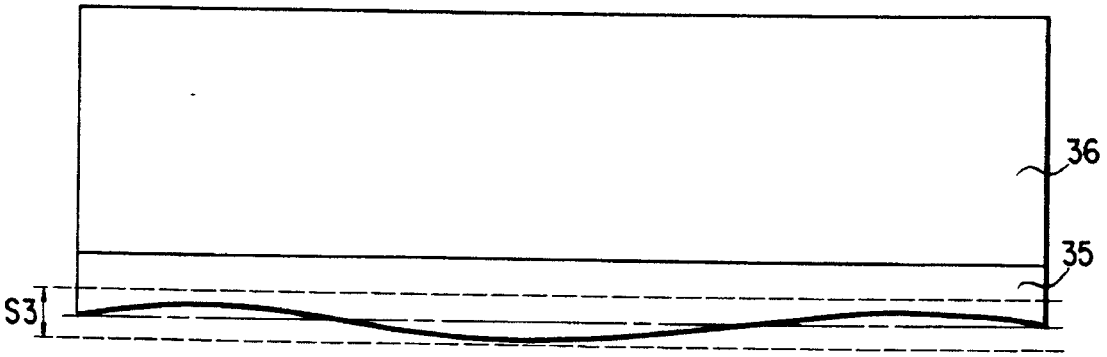
FIGS. 9A, 9B and 9C schematically show a deformation of the developing blade.
Figure 9B:
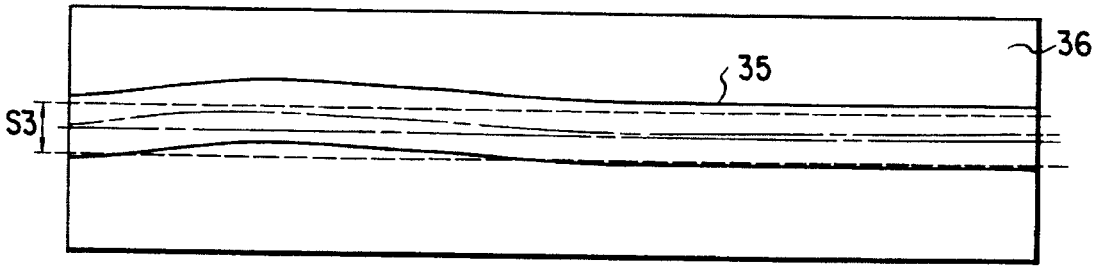

The tip portion (to be put in contact with the developing roller 34) of the developing blade 35 should also be straight. However, the tip portion is actually curved. The developing blade 35 is curved vertically, as shown in FIG. 9A, and horizontally, as shown in FIG. 9B. Thus, the tip portion of the blade 35 is curved three-dimensionally. Owing to such curve of the blade 35, a gap occurs between the developing roller 34 and developing blade 35, and toner particles pass therebetween with little friction. As a result, the amount of charge of toner decreases.

Figure 9C:
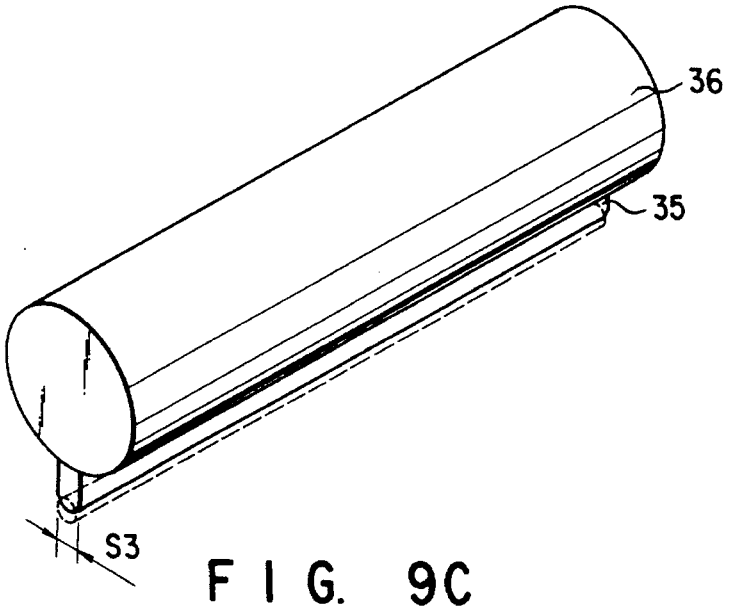

According to a fifth embodiment, the roundness S3 of the tip portion of the developing blade 35 is limited to 0.14 mm or less. Specifically, the developing blade 35 is formed such that the entire tip portion of the blade 35 is situated within a cylindrical region, as shown by broken lines in FIG. 9C, having a diameter of S3 (0.14 mm or less). The center of the cylindrical region is located at a tip portion of the blade 35 which is in a condition without any displacement.

Thereby, passing of toner particles with low friction can be prevented, and the toner is fully charged. The relationship between the roundness of the tip portion of the developing blade 35 and the fogging on the photosensitive drum 1 is substantially identical to that shown in FIG. 8, i.e. the relationship between the amount of displacement of the surface of the developing roller 34 and the fogging on the drum 1. Accordingly, if the roundness of the tip portion of blade 35 is 0.14 mm or less, the degree of fogging is 2% or less and there is no problem in visual aspects.

SIXTH EMBODIMENT

According to a sixth embodiment, the developing blade 35 is formed of a material tending to be worn due to contact with toner and developing roller 34 (in particular, toner). In this embodiment, the surface of the developing blade 35 is formed of a silicone resin, the toner includes a polyester resin, and the surface of the developing roller 34 is formed of an urethane elastomer.

According to this embodiment, the developing blade 35 is worn due to contact with the toner and developing roller 34, and a new surface is always exposed. If the blade 35 is not worn, the surface of the blade 35 is filmed with toner during long-time use. If a toner film is formed on the blade 35, friction between the blade 35 and toner decreases and an amount of charge of toner decreases. According to this embodiment, however, a new surface is always exposed, as mentioned above, and toner filming is prevented. Thus, suitable friction between toner and blade 35 is always ensured, and the toner can be fully charged.

SEVENTH EMBODIMENT

Charging of toner is not performed only between the developing roller 34 and developing blade 35, but also preliminarily between the supply roller 33 and developing roller 34. Toner carried by the supply roller 33 reaches a contact point between the supply roller 33 and developing roller 34. Since the supply roller 33 and developing roller 34 rotate in the same direction, the surface of the supply roller 33 and the surface of the developing roller 34 move in opposite directions at the contact point between the rollers 33 and 34. Accordingly, the toner reaching the contact point between supply roller 33 and developing roller 34 is subjected to friction between the supply roller 33 and developing roller 34 and the toner is charged.

If the toner is sufficiently charged preliminarily, the toner can retain a certain amount of charge even if it passes between the developing roller 34 and blade 35 with little friction, and fogging can be decreased.

According to a seventh embodiment, the supply roller 33 and developing roller 34 are arranged such that an overlap amount of the supply roller 33 and developing roller 34 is 0.3 mm or more.

Figure 10:
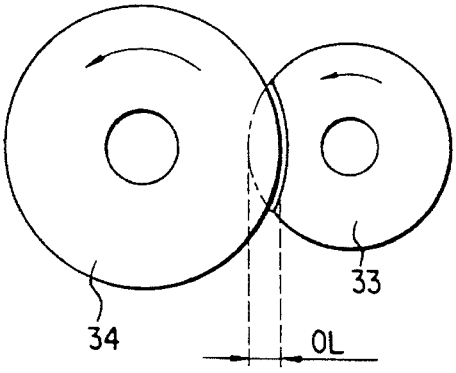
FIG. 10 schematically shows the contact between a toner supply roller and the developing roller.

FIG. 10 shows schematically the state of contact between the supply roller 33 and developing roller 34. As shown in FIG. 10, the rollers 33 and 34 are arranged in an overlapping state (FIG. 10 shows the overlapping state exaggeratedly). Since the hardness of the supply roller 33 is lower than that of the developing roller 34, the surface of the supply roller 33 is principally deformed and curved by the developing roller 34 (the developing roller 34 is also deformed and curved slightly). The overlapping amount of the rollers 33 and 34 is indicated by OL, and it is set to be 0.3 mm or more.

According to this embodiment, the supply roller 33 is put in close contact with the developing roller 34, and toner is exactly subjected to friction at the contact point between the rollers 33 and 34 and the toner can be fully charged preliminarily.

EIGHTH EMBODIMENT

According to an eighth embodiment, the toner hopper 31 is formed such that a maximum height L (FIG. 2) between the axis of the developing roller 34 and the toner containing space **31*a* within the toner hopper 31** is 60 mm or less.

Thereby, the maximum height of toner within the toner hopper 31 from the axis of the developing roller 34 is 60 mm or less.

Figure 11:
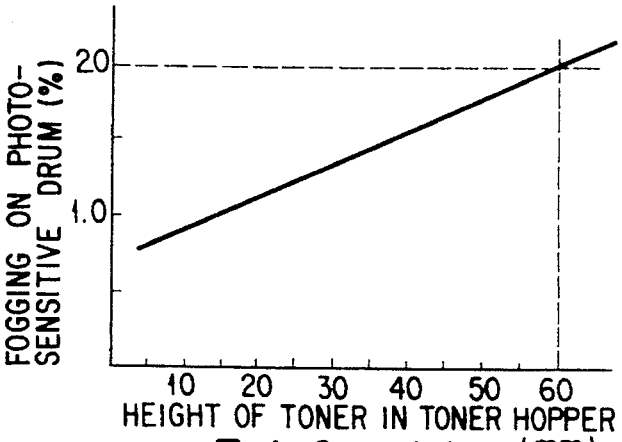
FIG. 11 shows the relationship between the height of toner contained in a toner hopper from the center of a shaft of the developing roller and the fogging on the photosensitive drum.

FIG. 11 shows the relationship between the height of toner contained in the toner hopper 31 from the axis of the developing roller 34 and the fogging on the photosensitive drum 1. As shown in FIG. 11, as the height of toner contained in the toner hopper 31 increases, the degree of fogging on the drum 1 increases. The reason for this is that the weight of toner contained in the hopper 31 acts on the toner particles at the contact point between the developing roller 34 and blade 35, and therefore the toner particles tend to pass between the roller 34 and blade 35 with little friction.

If the height of toner is 60 mm or less, the degree of fogging is 2% and there is no problem in visual aspects.

NINTH EMBODIMENT

In the preceding embodiments, the possibility of fogging is prevented by devising the structure of the developing device 3. In addition, the fogging can be reduced by using toner described below.

A toner having a following particle size distribution is used:

$$\sigma'/\mu' \leq 0.35$$

where $\mu'$ and $\sigma'$ are an average particle diameter and a standard deviation of the toner which is obtained on the basis of a distribution of particle diameter with regard to number.

That is, the ratio of the standard deviation $\sigma'$ to the average particle size of toner on the basis of number reference $\mu'$is 35% or less.

Figure 12:
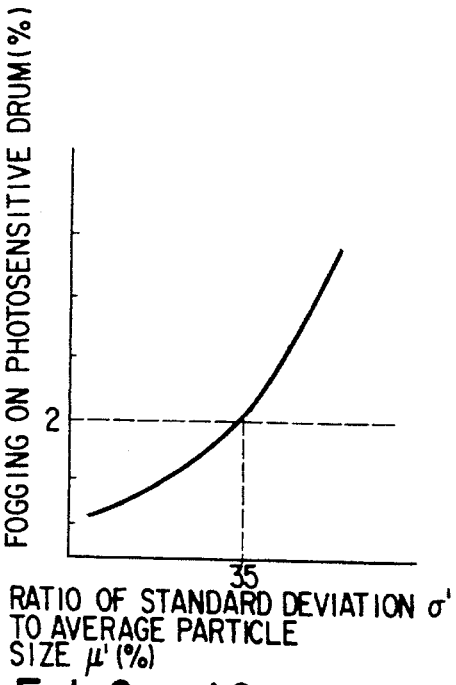
FIG. 12 shows the relationship between the ratio of a standard deviation to an average particle size of toner and the fogging on the photosensitive drum.

FIG. 12 shows the relationship between the ratio of the standard deviation to the average particle size of toner on the basis of number reference and the fogging on the photosensitive drum 1. It is understood, from FIG. 12, that the degree of fogging can be reduced to 2% or less, which causes no problem in visual aspects, by setting the ratio of the standard deviation to the average particle size of toner at 35% or less.

Figure 13:
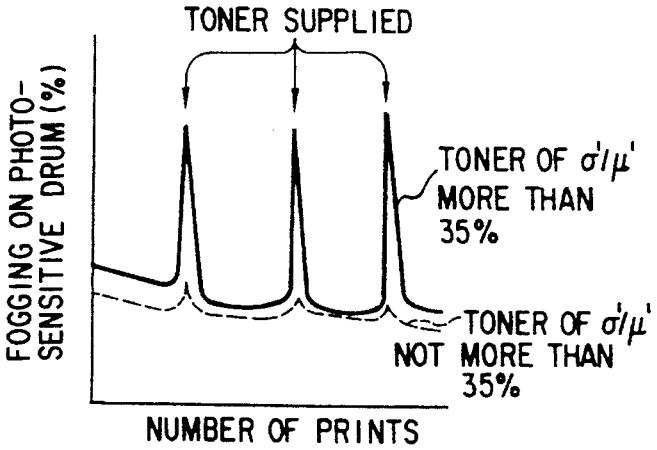
FIG. 13 shows a variation in the state of fogging on the photosensitive drum in the case of using toner whose ratio of a standard deviation to an average particle size of toner is 35% or less and the toner whose ratio of a standard deviation to an average particle size of toner is greater than 35%.

FIG. 13 shows a variation in the state of fogging on the photosensitive drum 1 in the case of using the toner whose ratio of a standard deviation to an average particle size is 35% or less and the toner shows ratio of a standard deviation to an average particle size is greater than 35%. As is clear from FIG. 13, the degree of fogging is lower in the case of using the toner whose ratio of a standard deviation to an average particle size is 35% or less. In addition, just after the toner is supplied, the toner at the contact point between the developing roller 34 and the developing blade 35 is pushed by the weight of the toner contained in the toner hopper 31, and the possibility of the toner passing between the roller 34 and the blade 35 with little friction increases and also the degree of fogging increases accordingly. At the time of toner supply, the degree of fogging increases remarkably in the case of using the toner whose ratio of a standard deviation to an average particle size is greater than 35%, whereas the degree of fogging is not high in the case of using the toner whose ratio of a standard deviation to an average particle size is 35% or less.

TENTH EMBODIMENT

In the ninth embodiment, the ratio of the standard deviation to the average particle size is defined. As regards the fogging, the influence of smaller-size toner particles is very great. The reason for this is that the smaller the particle size of toner, the higher the possibility of toner passing between the developing roller and blade 35 with little friction.

Thus, in the tenth embodiment, an amount of smaller-size toner particles is limited. The tenth embodiment employs toner in which the percentage of toner particles of $\mu'/2$ or less is 5% or less ($\mu'$: an average particle size of toner on the basis of number reference). For example, when the average particle size on the basis of number reference is 11 μm, the percentage of toner particles of 5.5 μm or less is 5% or less.

Figure 14:
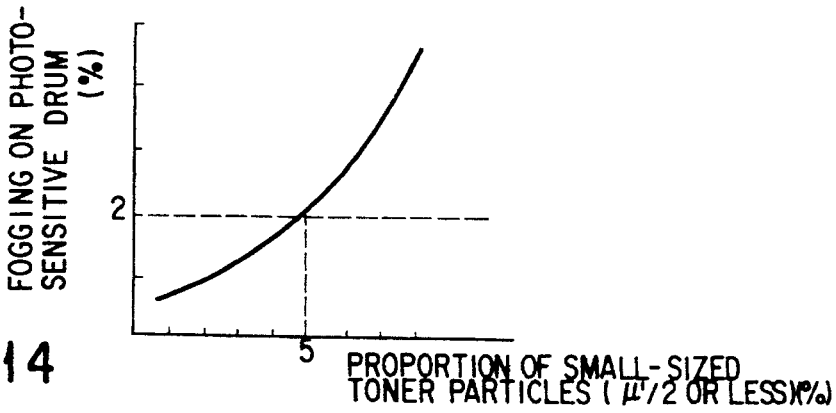
FIG. 14 shows the relationship between the proportion of small-sized toner particles and the fogging on the photosensitive drum.

FIG. 14 shows the relationship between the percentage of small-size toner particles ($\mu'/2$ or less) on the basis of number reference and the fogging on the photosensitive drum 1. From FIG. 14, it is understood that if the percentage of small-size toner particles is 5% or less, the degree of fogging can be reduced to 2% or less, which causes no problem in visual aspects.

The various structures for reducing fogging have been described above. The fogging can be fully reduced by each embodiment, but if some embodiments are combined, the advantage will be enhanced.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents. For example, the present invention is not limited to a facsimile apparatus, and may be applied to a copying machine and a printer.

What is claimed is:

1. A developing device for developing an electrostatic latent image formed on a photosensitive member in an electrophotographic apparatus utilizing toner, the developing device comprising:

means for containing the toner;

a developing roller for carrying on its surface the toner contained in said containing means and bringing the toner into contact with the photosensitive member; and a developing blade, adapted to be in contact with the developing roller, for charging by friction the toner carried on the developing roller, wherein the hardness of the developing blade is higher than the hardness of the developing roller and positioned to sufficiently deform the developing roller so that stable contact is maintained between the developing roller and the developing blade;

and further wherein the hardness of the developing blade is 79 $^{\pm}$4 degrees in JIS-A hardware and the hardness of the developing roller is 30 $^{\pm}$5 degrees in JIS-A hardness.

2. The developing device according to claim 1, wherein a ratio of a standard deviation to an average particle size based on number of the toner is 35% or less.

3. The developing device according to claim 1, wherein a percentage of toner particles having a particle size of ½ or less of an average particle size based on number of the toner is 5% or less.

4. A developing device for developing an electrostatic latent image formed on a photosensitive member in an electrophotographic apparatus utilizing toner, the developing device comprising:

means for containing the toner;

a developing roller, having a surface roughness, for carrying on its surface the toner contained in said containing means and bringing the toner into contact with the photosensitive member; and a developing blade, adapted to be in contact with the developing roller, for charging by friction the toner carried on the developing roller, wherein the average value of the surface roughness of the developing roller is less than the average particle size of the toner, and further wherein an average value of said surface roughness of the developing roller is lower than $\mu-2.32653\ \sigma$ and higher than 0.15 μ.

5. The developing device according to claim 4, wherein the average value of said surface roughness of the developing roller is $\mu-2.32635\sigma$ or less, where μ is the average particle size of the toner and σ is a standard deviation of the particle size distribution.

6. The developing device according to claim 4, wherein a ratio of a standard deviation to an average particle size based on number of the toner is 35% or less.

7. The developing device according to claim 4, wherein a percentage of toner particles having a particle size of ½ or less of an average particle size based on number of the toner is 5% or less.

8. A developing device for developing an electrostatic latent image formed on a photosensitive member in an electrophotographic apparatus utilizing toner, the developing device comprising:

means for containing the toner;

a developing roller for carrying on its surface the toner contained in said containing means and bringing the toner into contact with the photosensitive member; and a developing blade, adapted to be in contact with the developing roller, for charging by friction the toner carried on the developing roller, wherein the roundness of curvature of the tip of the developing blade is 0.14 mm or less.

9. The developing device according to claim 8, wherein a ratio of a standard deviation to an average particle size based on number of the toner is 35% or less.

10. The developing device according to claim 8, wherein a percentage of toner particles having a particle size of ½ or less of an average particle size based on number of the toner is 5% or less.

11. A developing device for developing an electrostatic latent image formed on a photosensitive member in an electrophotographic apparatus, the developing device comprising:

means for containing toner;

a developing roller for carrying on its surface the toner contained in said containing means and bringing the toner into contact with the photosensitive member; and a developing blade, adapted to be in contact with the developing roller, for charging by friction the toner carried on the developing roller, wherein a surface of the developing blade comprises a material tending to be worn due to contact with the toner.

12. A developing device according to claim 11, in which the surface of said developing blade comprises a silicone resin, the toner comprises a polyester resin, and the surface of said developing roller comprises an urethane elastomer.

13. The developing device according to claim 11, wherein a ratio of a standard deviation to an average particle size based on number of the toner is 35% or less.

14. The developing device according to claim 11, wherein a percentage of toner particles having a particle size of ½ or less of an average particle size based on number of the toner is 5% or less.

15. The developing device according to claim 12, wherein a ratio of a standard deviation to an average particle size based on number of the toner is 35% or less.

16. The developing device according to claim 12, wherein a percentage of toner particles having a particle size of ½ or less of an average particle size based on number of the toner is 5% or less.

* * * * *